US009501982B2

(12) United States Patent
Ukawa et al.

(10) Patent No.: US 9,501,982 B2
(45) Date of Patent: Nov. 22, 2016

(54) CALIBRATION APPARATUS, CONTROL METHOD THEREOF, AND IMAGE DISPLAY APPARATUS

(71) Applicant: CANON KABUSHIKI KAISHA, Tokyo (JP)

(72) Inventors: Satoshi Ukawa, Komae (JP); Tetsu Fukuda, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 14/275,149

(22) Filed: May 12, 2014

(65) Prior Publication Data

US 2014/0340374 A1 Nov. 20, 2014

(30) Foreign Application Priority Data

May 14, 2013 (JP) ..... 2013-102317

(51) Int. Cl.
*G09G 3/26* (2006.01)
*G09G 3/36* (2006.01)

(52) U.S. Cl.
CPC ..... *G09G 3/36* (2013.01); *G09G 2320/0233* (2013.01); *G09G 2320/0693* (2013.01); *G09G 2360/145* (2013.01)

(58) Field of Classification Search
CPC ..... G09G 2320/0233; G09G 2320/0693; G09G 2360/145; G09G 3/36
See application file for complete search history.

(56) References Cited

U.S. PATENT DOCUMENTS 7,768,537 B2 * 8/2010 Tognoni ..... G09G 5/20 345/611
8,314,783 B2 * 11/2012 Sambandan ..... G09G 3/3233 345/204
8,698,701 B2 * 4/2014 Margulis ..... G03B 21/00 345/1.1

FOREIGN PATENT DOCUMENTS

JP 2007-034209 A 2/2007
JP 2012-014004 A 1/2012

* cited by examiner

*Primary Examiner* — Abbas Abdulselam
(74) *Attorney, Agent, or Firm* — Cowan, Liebowitz & Latman, P.C.

(57) ABSTRACT

A calibration apparatus including: a measuring unit configured to measure optical characteristics at a measurement position on a screen of an image display apparatus; a storing unit configured to store information on correspondence determined in advance among the optical characteristics at the measurement position and optical characteristics at a plurality of prescribed positions on the screen; an acquiring unit configured to acquire a representative position of an image displayed on the screen; and a calibrating unit configured to perform calibration based on the measurement value measured by the measuring unit, information on the correspondence, and a positional relationship among the plurality of prescribed positions and the representative position.

20 Claims, 21 Drawing Sheets

| DISPLAY MODE | CALIBRATION TARGET OR NOT |
|---|---|
| DIAG_DCM | TARGET |
| DIAG_CLR | TARGET |
| COLOR | NOT TARGET |

T501
T502
T503

Fig.4

| COLOR | R | G | B |
|---|---|---|---|
| BLACK | 0 | 0 | 0 |
| WHITE | 255 | 255 | 255 |
| RED | 255 | 0 | 0 |
| GREEN | 0 | 255 | 0 |
| BLUE | 0 | 0 | 255 |

T1701
T1702
T1703
T1704
T1705

*Fig.15*

CALIBRATION APPARATUS, CONTROL METHOD THEREOF, AND IMAGE DISPLAY APPARATUS

BACKGROUND OF THE INVENTION

1. Field of the Invention

The present invention relates to a calibration apparatus, a control method thereof, and an image display apparatus.

2. Description of the Related Art

A plurality of vertically-installed liquid crystal display apparatuses are sometimes arranged side by side to be used as medical liquid crystal display apparatuses. However, when liquid crystal display apparatuses are arranged side by side, the presence of centrally arranged bezels of the liquid crystal display apparatuses obstructs a field of view. Therefore, a large-size liquid crystal display apparatus that is twice as large is sometimes used. In addition, there are medical liquid crystal display apparatuses capable of dividing an image display region of the liquid crystal display apparatus into a plurality of regions and applying a different gradation curve or brightness to each region. Furthermore, there are medical liquid crystal display apparatuses which include a sensor for measuring brightness or chromaticity on the front of a peripheral part of a screen (hereinafter, front sensor) and which are capable of performing a quality management test or calibration of the liquid crystal display apparatus without using an externally-installed sensor which is provided separately from the liquid crystal display apparatus (hereinafter, external sensor).

However, since liquid crystal display apparatuses characteristically have greater color unevenness and brightness unevenness in a peripheral part than a central part of a screen, techniques are being proposed for associating a measurement value in the peripheral part as taken by a front sensor and a measurement value of the central part as taken by an external sensor. For example, Japanese Patent Application Laid-open No. 2007-34209 proposes storing a relative ratio of a central part and a peripheral part of a liquid crystal display apparatus in advance and, during calibration, converting brightness measured by a front sensor during calibration into brightness of the central part based on the relative ratio. In this case, brightness of the liquid crystal display apparatus is adjusted based on the brightness of the central part. In addition, for example, Japanese Patent Application Laid-open No. 2012-14004 proposes calculating a characteristic quantity of a central part of a screen based on a characteristic quantity of a peripheral part as measured by a front sensor and a correction value for correcting a gradation value of an input signal according to characteristics of display unevenness of the screen.

SUMMARY OF THE INVENTION

However, when performing image diagnosis using a liquid crystal display apparatus, a center of the liquid crystal display apparatus and a center of a region displaying a medical image for diagnosis (hereinafter, diagnostic region) are not necessarily consistent with each other. When the center of the liquid crystal display apparatus and the center of diagnostic region are separated from each other, even if a measurement value of a front sensor is associated with a measurement value at a center of the liquid crystal display apparatus according to the conventional techniques described above, a deviation occurs from a measurement value at a center of a diagnostic region that is brought into attention for diagnosis. In other words, even if a measurement value at a position separated from the diagnostic region and a measurement value of the front sensor are associated with each other, a proper quality management test or proper calibration cannot be performed with respect to the diagnostic region. Therefore, display accuracy in the diagnostic region cannot be enhanced.

In consideration thereof, the present invention enhances accuracy of calibration in a display region of an image brought into attention by an observer in an image display apparatus which includes a sensor and which performs calibration based on a measurement value of the sensor.

A first aspect of the present invention is a calibration apparatus including:

a measuring unit configured to measure optical characteristics at a measurement position on a screen of an image display apparatus;

a storing unit configured to store information on correspondence determined in advance among the optical characteristics at the measurement position and optical characteristics at a plurality of prescribed positions on the screen;

an acquiring unit configured to acquire a representative position of an image displayed on the screen; and a calibrating unit configured to perform calibration based on a measurement value measured by the measuring unit, information on the correspondence, and a positional relationship among the plurality of prescribed positions and the representative position.

A second aspect of the present invention is a control method of a calibration apparatus, the method including:

measuring optical characteristics at a measurement position on a screen of an image display apparatus;

storing information on correspondence determined in advance among the optical characteristics at the measurement position and optical characteristics at a plurality of prescribed positions on the screen;

acquiring a representative position of an image displayed on the screen; and performing calibration based on the measurement value measured in the measuring, information on the correspondence, and a positional relationship among the plurality of prescribed positions and the representative position.

The present invention is capable of enhancing accuracy of calibration in a display region of an image brought into attention by an observer in an image display apparatus which includes a sensor and which performs calibration based on a measurement value of the sensor.

Further features of the present invention will become apparent from the following description of exemplary embodiments (with reference to the attached drawings).

BRIEF DESCRIPTION OF THE DRAWINGS

FIG. 4 is a diagram showing correspondence between display modes and whether or not the display modes are targeted for calibration;

FIG. 15 is a diagram showing RGB values of patches used for measurement;

DESCRIPTION OF THE EMBODIMENTS

First Embodiment

Figure 1:
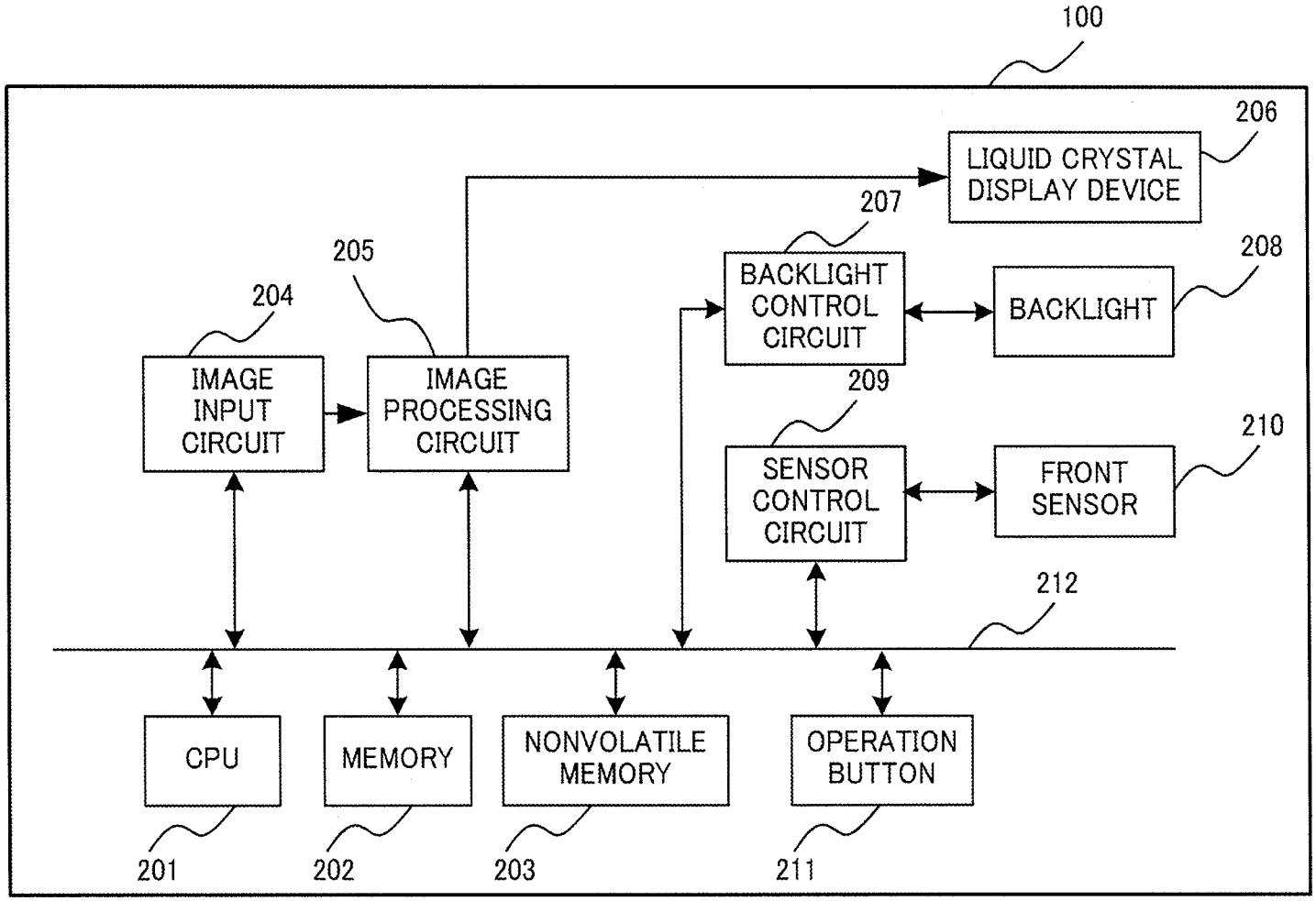
FIG. 1 is a hardware block diagram of a liquid crystal display apparatus.

FIG. 1 is a hardware block diagram of a liquid crystal display apparatus 100 to which a first embodiment of the present invention is applied.

A CPU 201 reads a program for performing various controls from a nonvolatile memory 203 and controls respective constituent blocks connected to an internal bus 212. Based on an input image signal, the CPU 201 calculates display region information that represents which image processing parameter is to be applied to each region in an image display region. The CPU 201 performs an association process using the display region information and association data recorded on the nonvolatile memory 203.

In this case, the liquid crystal display apparatus according to the present embodiment has a plurality of display modes with different settings of the image processing parameter and is capable of dividing the image display region into a plurality of regions and performing image display in a different display mode for each region. For example, region division can be performed so that DICOM GSDF is applied to a given region and γ2.2 is applied to another region as image processing parameters. Modes of region division are arbitrary. For example, conceivable modes include left-right two-way division, up-down two-way division, tile-like division, division into a small central region and a peripheral frame-like region, and division into a small corner region and an L-shaped region sharing three sides.

In the present embodiment, an optimal display mode is individually set for each of a plurality of divided regions that constitute a screen according to the type of image to be displayed such as a medical image or a graphical user interface (GUI). It is assumed that the present embodiment has three display modes including DIAG_DCM and DIAG_CLR for displaying medical images and COLOR for displaying images such as a GUI. Specific display settings in each display mode will not be discussed in detail herein. Display region information is information related to such divided regions that divide a screen according to a display mode.

In addition, association data refers to data that is created and recorded in advance based on a measurement result taken by an external sensor or the like when the liquid crystal display apparatus is being manufactured or the like. Specifically, association data is data representing correspondence between a measurement result of brightness or chromaticity at a measurement position taken by a front sensor and a measurement result of brightness or chromaticity at a prescribed position that differs from the measurement position. In the present embodiment, a case where association data is created based on a measurement result of brightness or chromaticity at a central position of each block that divides a screen into a plurality of regions as a measurement result of brightness or chromaticity at a prescribed position that differs from the measurement position will be described as an example. An association process is a process which, based on the association data, converts a measurement value of brightness or chromaticity taken by the front sensor into a value (estimated value) of brightness or chromaticity at an arbitrary position. In the present embodiment, an association process will be exemplified in which brightness or chromaticity as optical characteristics at a representative position of an attention region is estimated based on the association data, a measurement value taken by the front sensor, and a positional relationship between the representative position of the attention region and the predetermined position among an image displayed on the screen.

A memory 202 temporarily stores data used in the processes performed by the CPU 201.

The nonvolatile memory 203 stores program information necessary for the CPU 201 to operate, backlight emission parameters such as backlight brightness when an image of an image input circuit 204 is displayed, and image quality adjustment parameters such as a lookup table used by an image processing circuit to perform correction. In addition, the nonvolatile memory 203 stores association data. Moreover, association data is measured when the liquid crystal display apparatus 100 is being manufactured and stored in advance in the nonvolatile memory 203.

The image input circuit 204 receives an input image signal from a PC 101 and outputs the input image signal to the image processing circuit 205. In addition, the image input circuit 204 receives a control signal from the PC 101 and outputs the control signal to the CPU 201, and outputs a response from the CPU 201 to the PC 101.

The image processing circuit 205 performs processing based on display region information acquired from the CPU 201 and an image quality adjustment parameter recorded on the nonvolatile memory 203 on an image signal received from the image input circuit 204 and outputs the image signal to a liquid crystal display device 206.

The liquid crystal display device 206 displays an image based on the image signal received from the image processing circuit 205 and presents the image to a user.

A backlight control circuit 207 outputs backlight control information for controlling light emission by a backlight 208 based on a backlight emission parameter recorded on the nonvolatile memory 203.

The backlight 208 emits light based on the backlight control information received from the backlight control circuit 207.

A sensor control circuit 209 outputs sensor control information for controlling a front sensor 210 based on a measurement request received from the CPU 201 and outputs brightness or chromaticity measured by the front sensor 210 to the CPU 201.

The front sensor 210 is installed on a surface of the liquid crystal display device 206 and measures optical characteristics (brightness or chromaticity) of the liquid crystal display device 206 based on the sensor control information received from the sensor control circuit 209 and outputs the optical characteristics to the sensor control circuit 209.

An operation button 211 accepts operations by the user and notifies operation contents to the CPU 201.

An internal bus 212 connects the respective constituent blocks of the liquid crystal display apparatus 100 and performs data communication.

Figure 2:
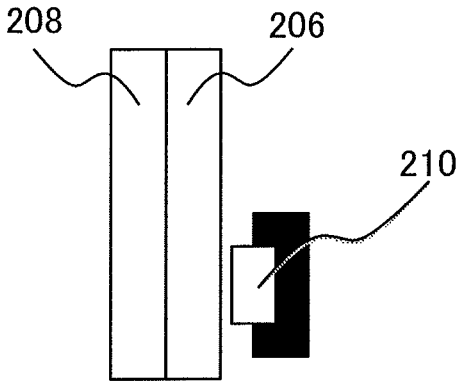
FIG. 2 is a schematic diagram of a cross section in a vicinity of a front sensor in a liquid crystal display apparatus.

FIG. 2 is a diagram schematically showing a cross section in a vicinity of the front sensor 210 among the liquid crystal display apparatus 100. The front sensor 210 is installed so as to oppose the liquid crystal display device 206 provided on the backlight 208 and is capable of measuring brightness or chromaticity.

Figure 3:
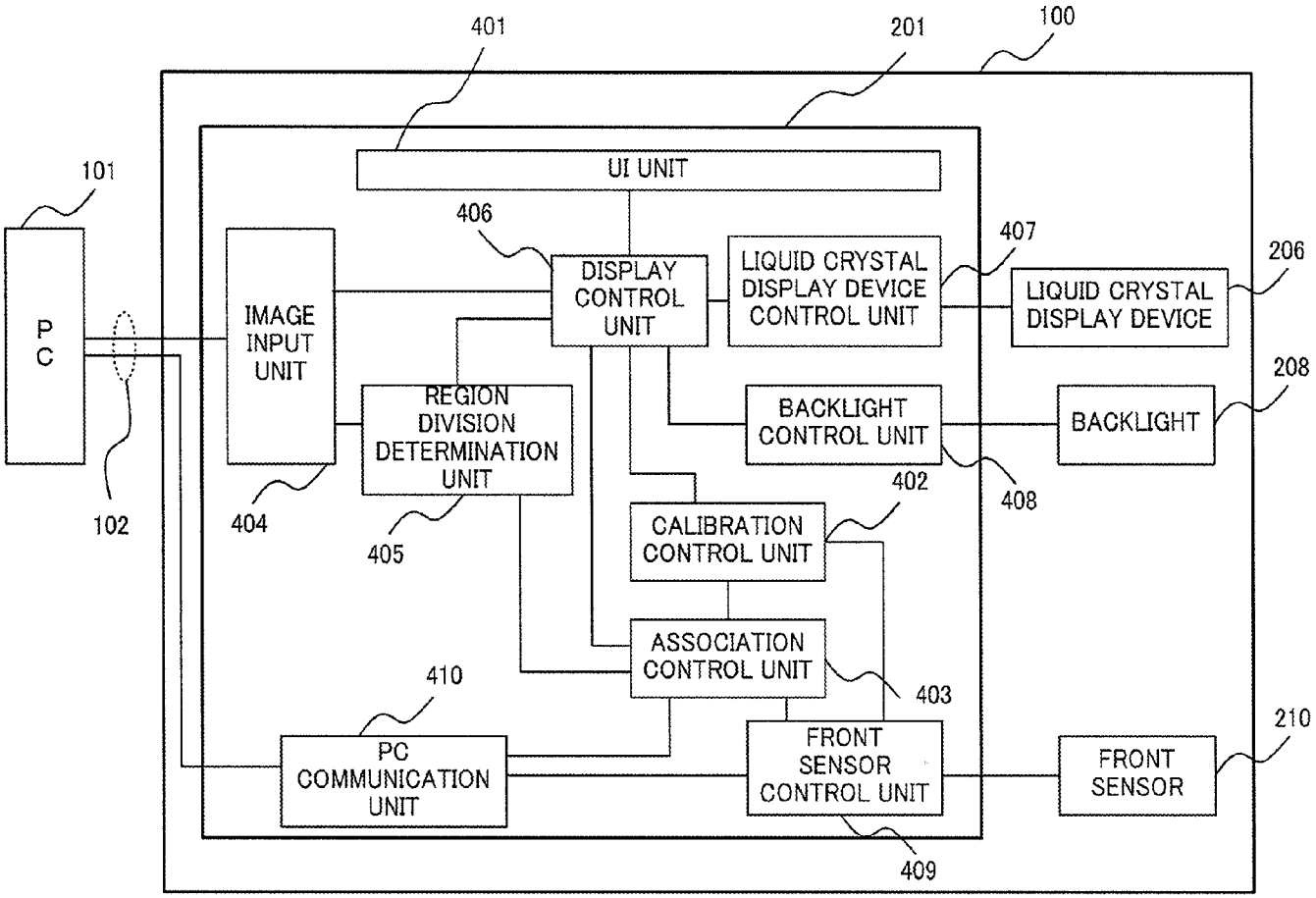
FIG. 3 is a functional block diagram of a liquid crystal display apparatus.

FIG. 3 is a diagram showing a connection mode of the liquid crystal display apparatus and an image output apparatus to which the first embodiment of the present invention is applied and functional blocks of the liquid crystal display apparatus 100.

The PC 101 is connected via an image cable 102 to the liquid crystal display apparatus 100. The liquid crystal display apparatus 100 receives an image signal from the PC 101 and displays the image signal. The image cable 102 conforms to the DVI™ standard or the DisplayPort™ standard and is capable of performing data communication based on the image signal and display data channel command interface (DDC/CI). The liquid crystal display apparatus 100 is configured so as to transmit and receive control signals to and from the PC 101 via the image cable 102 and to perform measurements using the front sensor based on the control signals. In addition, the liquid crystal display apparatus 100 transmits a measurement value taken by the front sensor to the PC 101.

Processes of the respective units shown in FIG. 3 are executed by the CPU 201.

A UI unit 401 generates image data of a user interface screen based on an operation performed using the operation button 211 by the user and outputs the image data to a display control unit 406.

A calibration control unit 402 periodically displays a patch in a measurement region used by the front sensor at intervals determined in advance and determines whether or not calibration is necessary based on a measurement value taken by the front sensor. The calibration control unit 402 performs calibration when it is determined that calibration is necessary. In addition, the calibration control unit 402 makes a request to an association control unit 403 to perform an association process. Details of the processing performed by the calibration control unit 402 will be described later. Alternatively, a configuration may be adopted in which intervals of performing calibration can be modified by the user.

The association control unit 403 performs an association process in which a measurement value of brightness or chromaticity acquired from a front sensor control unit 409 is converted into brightness or chromaticity at a specified location of the liquid crystal display apparatus 100. Details of the association process will be given later. In addition, the association control unit 403 converts brightness or chromaticity measured by the front sensor 210 based on a request from the calibration control unit 402 or a PC communication unit 410. The association control unit 403 acquires association data from a nonvolatile memory that is a storing unit (a second acquiring unit) and, based on the association data, estimates brightness or chromaticity at an arbitrary position from a measurement value taken by the front sensor control unit.

An image input unit 404 outputs an image signal received from the image input circuit 204 to an region division determination unit 405 and a display control unit 406.

The region division determination unit 405 is a third acquiring unit which, based on the image signal received from the image input unit 404, divides the image display region into regions according to display modes corresponding to the displayed image and acquires display region information representing information of a display mode to be applied to each region. The region division determination unit 405 outputs the display region information to the display control unit 406 and the association control unit 403.

The display control unit 406 performs image processing corresponding to the display modes on the image signal received from the image input unit 404 based on an image processing parameter and performs output to a liquid crystal display device control unit 407. In doing so, the display control unit 406 performs image processing corresponding to the display mode for each region based on the display region information received from the region division determination unit 405. In addition, based on a backlight emission parameter, the display control unit 406 outputs backlight emission control data corresponding to the display mode for each region to a backlight control unit 408. Furthermore, when performing calibration or an association process, the display control unit 406 superimposes a signal for displaying a patch image on the image signal in response to a request from the calibration control unit 402 or the association control unit 403.

The liquid crystal display device control unit 407 outputs the image signal received from the display control unit 406 to the liquid crystal display device 206.

The backlight control unit 408 outputs backlight emission control data received from the display control unit 406 to the backlight 208.

The front sensor control unit 409 is a first acquiring unit which controls the front sensor 210 based on a measurement request received from the calibration control unit 402, the association control unit 403, or the PC communication unit 410 and which acquires a measurement value of brightness or chromaticity.

The PC communication unit 410 performs a measurement value acquisition process in which a measurement request is outputted to the front sensor control unit 409 based on a control signal from the PC 101 and brightness or chromaticity acquired from the front sensor control unit 409 is outputted to the PC 101. Details of the measurement value acquisition process will be given later.

FIG. 4 is a diagram showing display modes that are set for the liquid crystal display apparatus 100 and whether or not each display mode is a calibration target. FIG. 4 shows that a display mode "DIAD_DCM" is a calibration target (T501) and that a display mode "DIAG_CLR" is a calibration target (T502). FIG. 4 also shows that a display mode "COLOR" is not a calibration target (T503).

Figure 5:
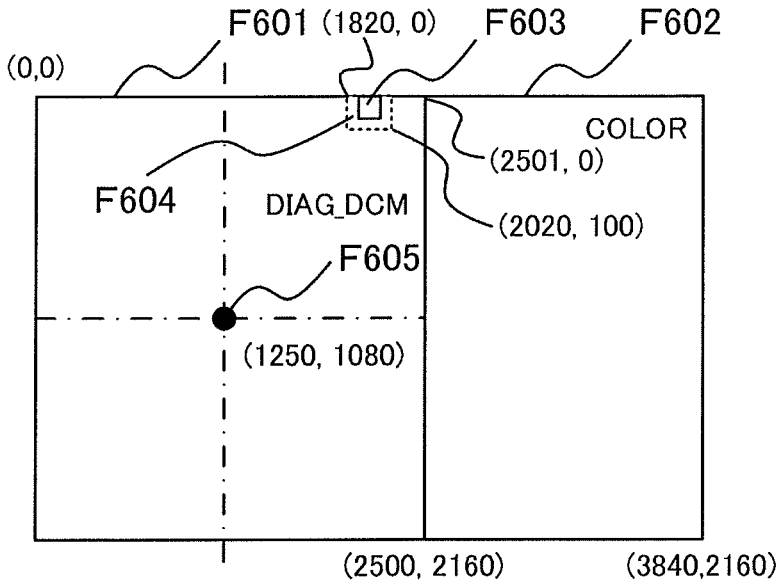
FIG. 5 shows an example of region division according to display modes of an image display region of a liquid crystal display apparatus.

FIG. 5 is a diagram showing an example of a state where display mode division of the image display region of the liquid crystal display apparatus 100 is performed so as to coincide with execution of calibration by the calibration control unit 402. Among the image display region of the liquid crystal display apparatus 100, a rectangular region F601 from coordinate (0, 0) to coordinate (2500, 2160) is displayed in the DIAG_DCM display mode and a rectangular region F602 from coordinate (2501, 0) to coordinate (3840, 2160) is displayed in the COLOR display mode. In addition, the front sensor is installed at a position F603 at the center of an upper edge part of the screen, and a patch when a measurement is taken by the front sensor is displayed in a rectangular region F604 from coordinate (1820, 0) to coordinate (2020, 100).

Moreover, in this case, a center coordinate (representative position) F605 when performing an association process (to be described later) is (1250, 1080) that is a center coordinate of the display region F601 of the DIAG_DCM mode.

Figure 6:
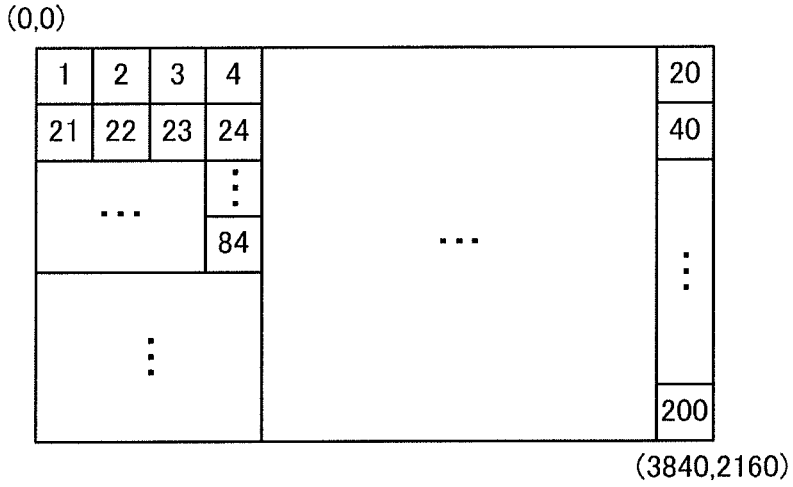
FIG. 6 is a diagram showing block division of a screen.

FIG. 6 illustrates regions of which association data to be used in an association process is retained. As shown in FIG. 6, in the present embodiment, the screen of the liquid crystal display apparatus 100 is divided by 20 in a left-right direction and 10 in a up-down direction, and association data used in an association process is stored for each of a total of 200 regions (blocks). The center coordinate F605 shown in FIG. 5 belongs to a block denoted by number 84 in FIG. 6. Moreover, specifically, the association data stored for each block is a 3×3 matrix that converts brightness or chromaticity as measured by the front sensor into brightness or chromaticity of each block in an XYZ color system. A value of association data is calculated in advance based on correspondence between brightness and chromaticity of each block as measured by a colorimetric sensor when the liquid crystal display apparatus 100 is being manufactured and brightness and chromaticity of the region F604 as measured by the front sensor during manufacture, and recorded on the nonvolatile memory 203.

A measurement value is converted according to Equation 1 below.

$$\begin{bmatrix} Xout \\ Yout \\ Zout \end{bmatrix} = [Mtx] \cdot \begin{bmatrix} Xin \\ Yin \\ Zin \end{bmatrix} \quad \text{[Expression 1]}$$

where Xout, Yout, and Zout represents brightness or chromaticity after conversion that is obtained as a result of the calculation, Mtx represents a 3×3 matrix that is used for the conversion, and Xin, Yin, and Zin represents measurement values of brightness or chromaticity that are acquired from the front sensor 210.

In addition, a value expressed by Equation 2 below is stored in advance as association data Mtx corresponding to the block 84.

$$[Mtx] = \begin{bmatrix} 0.95 & 0.05 & 0.01 \\ 0.08 & 0.97 & 0.08 \\ 0.09 & 0.01 & 0.98 \end{bmatrix} \quad \text{[Expression 2]}$$

Figure 7:
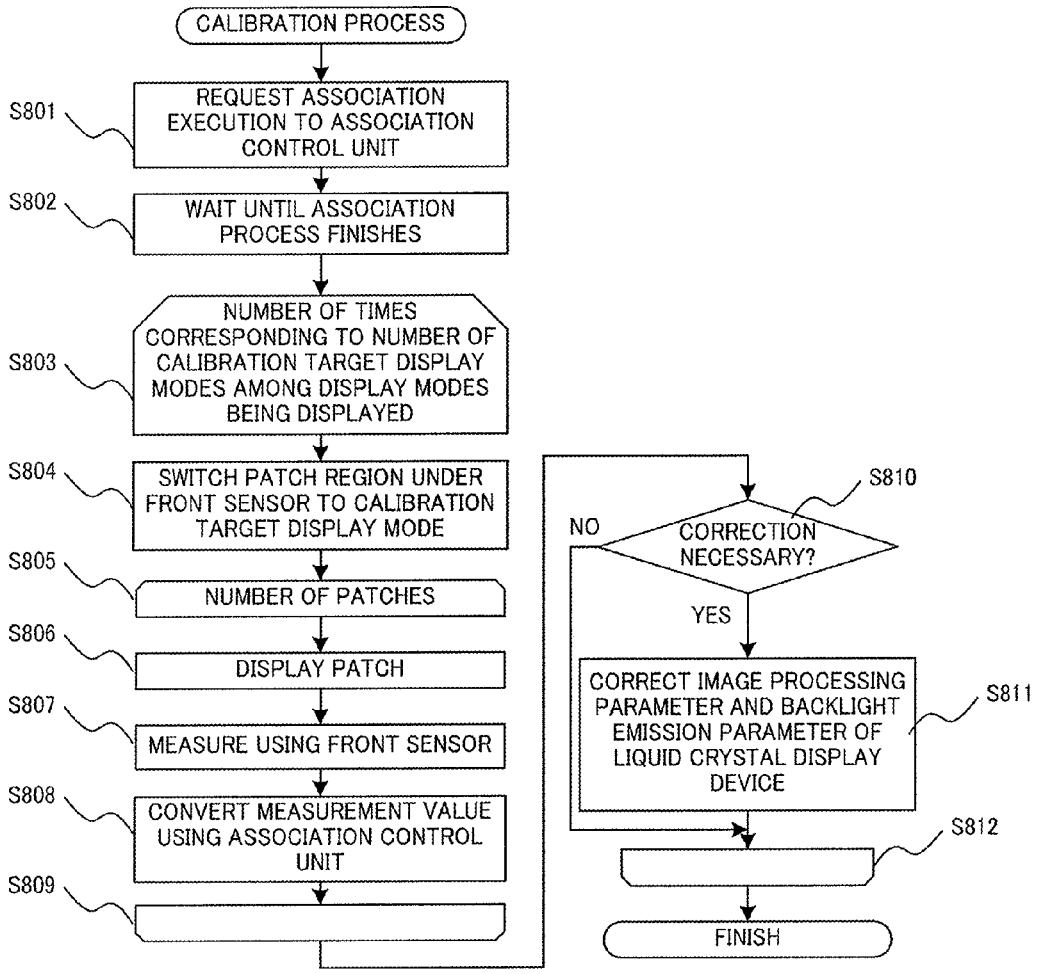
FIG. 7 is a flow chart of a calibration process.

FIG. 7 is a flow chart of a calibration process that is regularly performed by the calibration control unit 402. When a prescribed amount of time has lapsed from previous calibration, the calibration control unit 402 transmits an association execution request to the association control unit 403 (S801). Next, the calibration control unit 402 stands by until the association process by the association control unit 403 is finished (S802). Subsequently, the calibration control unit 402 performs calibration by repeating the processes of S804 to S812 a number of times corresponding to the number of calibration target modes among the display modes that are being displayed (S803). In the case of the display state shown in FIG. 5, since "DIAG_DCM" is the only calibration target display mode among the display modes that are being displayed, the processes of S804 to S812 are only performed once.

First, the calibration control unit 402 switches the display mode of the rectangular region F604 to the calibration target display mode (S804). In the case of the display state shown in FIG. 5, the calibration control unit 402 switches the display mode of the rectangular region F604 to "DIAG_DCM". Moreover, since the rectangular region F604 is included in the rectangular region F601 and the display mode of the rectangular region F601 is DIAG_DCM in the display state shown in FIG. 5, the display mode of the rectangular region F604 is already set to "DIAG_DCM" before performing switching. Therefore, display of the rectangular region F604 remains unchanged despite the execution of S804.

Next, the calibration control unit 402 repeats the processes of S806 to S809 a number of times corresponding to the number of prescribed patches necessary for calibration (S805). First, the calibration control unit 402 displays a patch in the rectangular region F604 (S806), issues a sensor value acquisition request to the front sensor control unit 409, and measures brightness or chromaticity using the front sensor 210 (S807). Next, the calibration control unit 402 delivers the measurement value of brightness or chromaticity acquired in S807 to the association control unit 403 and, based on the measurement value, converts the brightness or chromaticity to brightness or chromaticity in a vicinity of the center coordinate F605 that is an association execution coordinate (S808). Subsequently, the calibration control unit 402 returns to S805 to repeat similar processes with respect to the other patches (S809).

After measurements for all of the patches are finished, the calibration control unit 402 determines whether or not correction of the liquid crystal display apparatus 100 is necessary (S810). When it is determined that correction is necessary (YES in S810), the calibration control unit 402 corrects the image processing parameter and the backlight emission parameter of the liquid crystal display apparatus 100 based on prescribed calculations (S811). Moreover, when it is determined in S810 that correction is unnecessary, the calibration control unit 402 returns to S803 to repeat similar processes for display modes that are not yet processed without performing the process of S811 (S812). In the case of FIG. 5, since there is only one processing target display mode, the calibration process is finished in the case of NO in S810 or after the process of S811 is finished.

Figure 8:
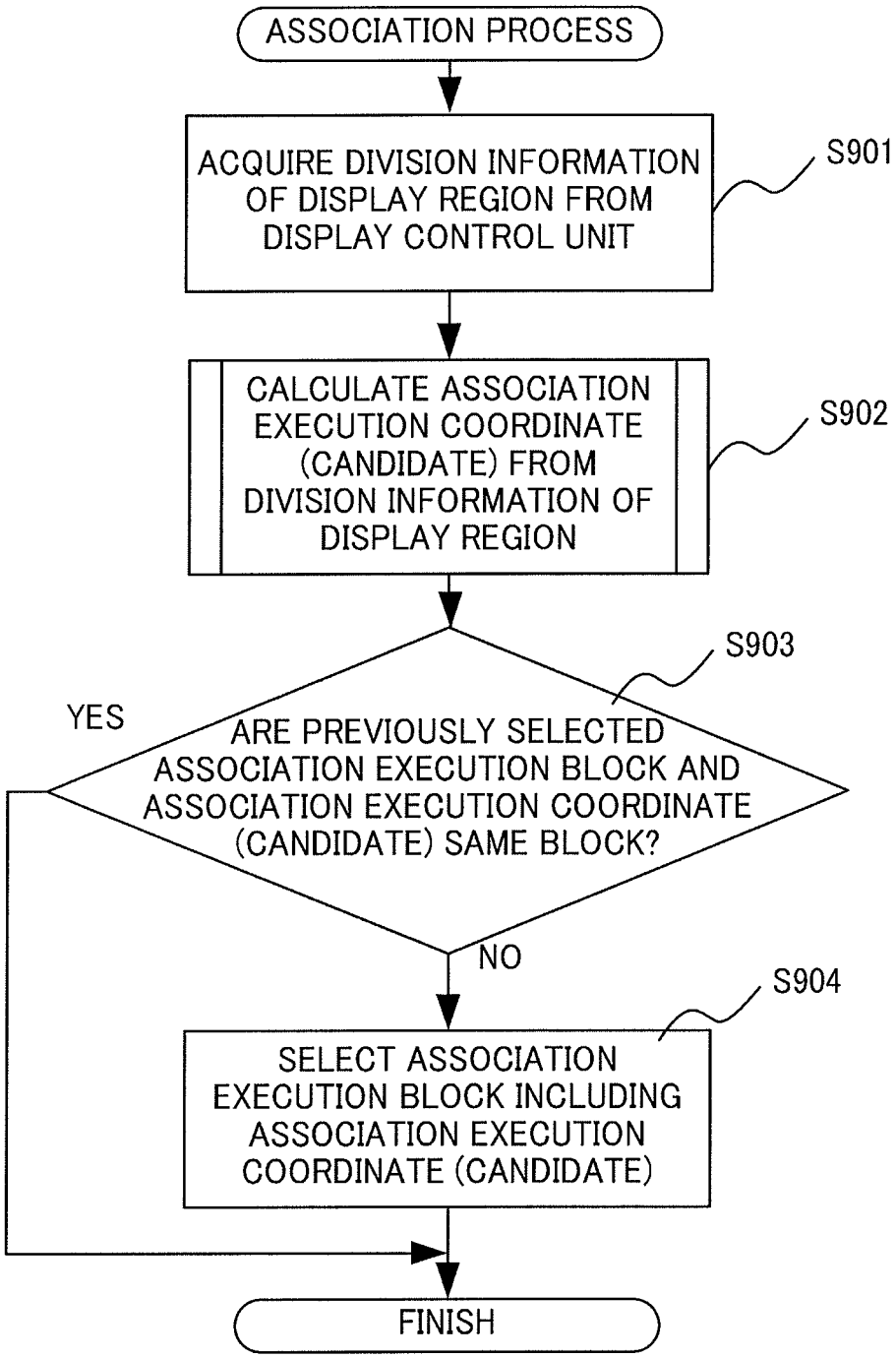
FIG. 8 is a flow chart of an association process.

FIG. 8 is a flow chart of the association process that is performed by the association control unit 403. Upon receiving the association execution request from the calibration control unit 402, the association control unit 403 acquires display region information which represents how the image display region is to be divided into regions and which display mode is applied to each region from the display control unit 406 (S901). Next, the association control unit 403 calculates a candidate of an association execution coordinate from the display region information (S902). In the case of the display state shown in FIG. 5, the association control unit 403 calculates the center coordinate F605 of the region of the display mode "DIAG_DCM" as a candidate of an association execution coordinate. A method of calculation will be described later. Subsequently, the association control unit 403 checks whether a block that includes the candidate of an association execution coordinate in the current process and a previously selected association execution block are the same block in the block division shown in FIG. 6 (S903). When the blocks are not the same (NO in S903), the association control unit 403 selects the block that includes the candidate of an association execution coordinate as the association execution block (S904). Moreover, when the previously selected association execution block and the block that includes the candidate of an association execution coordinate are the same block (YES in S903), since the association control unit 403 need not perform an association process again, processing is finished as is. In the case of the display state shown in FIG. 5, the association control unit 403 selects the block 84 shown in FIG. 6 as the block including a candidate F605 of an association execution coordinate and assumes the block to be an association execution block.

Figure 9:
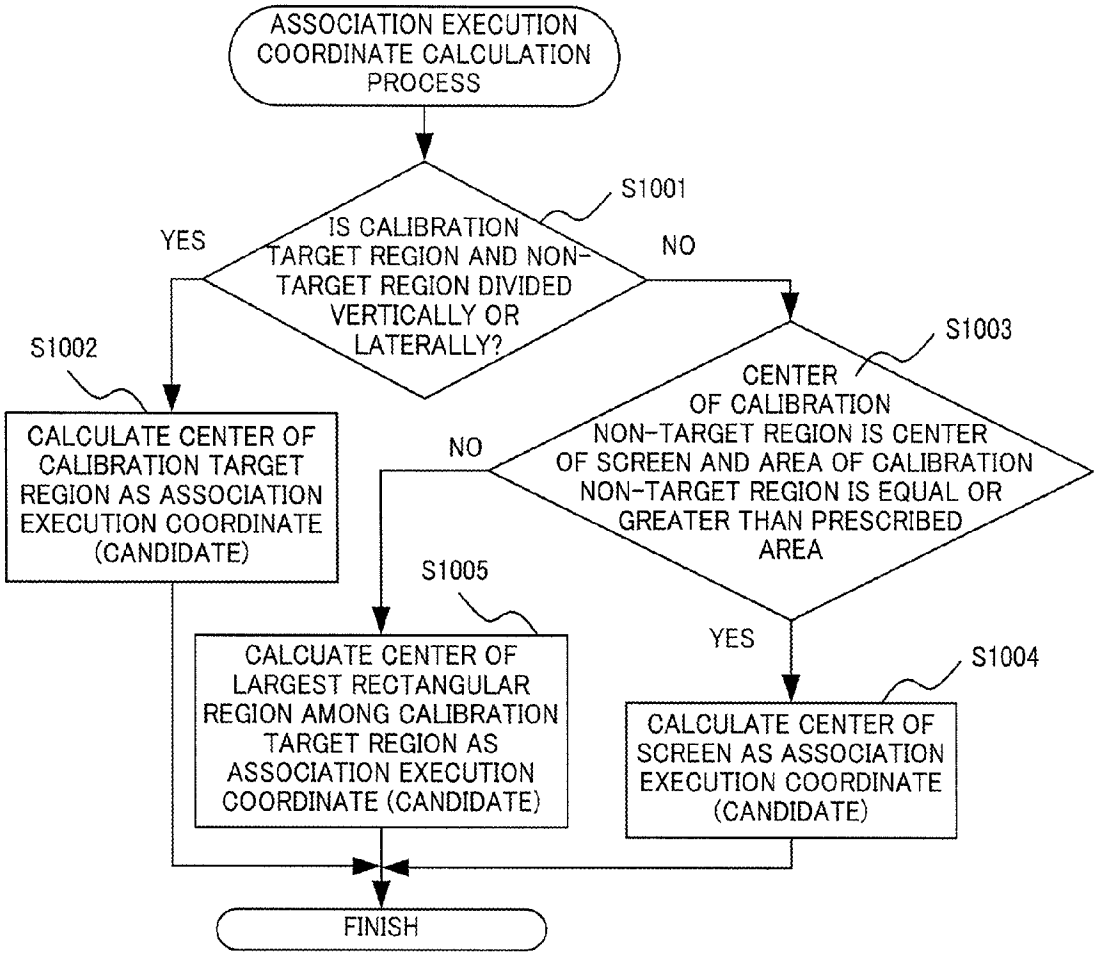
FIG. 9 is a flow chart of a process for calculating a candidate of an association execution coordinate.

FIG. 9 is a flow chart of a process for calculating a candidate of an association execution coordinate in the process of S902 among the processes shown in FIG. 8. Based on information of region division according to the display modes of the image display region, the association control unit 403 determines whether the division of the image display region by a region of a display mode that is a calibration target and a region of a display mode that is not a calibration target is up-down division or left-right division (S1001). When the image display region is divided in an up-down manner or a left-right manner (YES in S1001), the association control unit 403 calculates a center coordinate of the region of the display mode that is a calibration target as a candidate of an association execution coordinate (1002). When the division of the image display region is not up-down division or left-right division (NO in S1001), the association control unit 403 proceeds to S1003. Division of the image display region that is not up-down division or left-right division is, for example, division into a rectangular region including any of the corners of the screen and a remaining L-shaped region or division into a rectangular region at a central part of the screen and a peripheral frame-like region. For example, up-down division and left-right division may include tile-like (matrix-like or checkerboard-like) division.

In S1003, the association control unit 403 determines whether a center of the region of the display mode that is not a calibration target is the center of the image display region and whether an area of the region of the display mode that is not a calibration target is equal to or greater than a predetermined threshold (S1003). When the center of the region of the display mode that is not a calibration target is the center of the image display region or in a vicinity thereof and the area of the region of the display mode that is not a calibration target is equal to or greater than a predetermined threshold (YES in S1003), the association control unit 403 calculates the center of the image display region as a candidate of an association execution coordinate (S1004). On the other hand, when the condition described above is not satisfied (NO in S1003), the association control unit 403 calculates a center of a rectangular region with a greatest area among the regions of the display mode that is a calibration target as a candidate of an association execution coordinate (S1005).

In the case of the display state shown in FIG. 5, by performing the processes of FIGS. 8 and 9, since the region division according to the display modes is left-right division, the center coordinate F605 of the rectangular region F601 is calculated as an association execution coordinate. In addition, the block 84 shown in FIG. 6 which includes the calculated coordinate F605 is selected as an association execution block and a matrix (Expression 2) corresponding to the block 84 is selected as association data to be used in the association process. Furthermore, in the calibration process shown in FIG. 7, the matrix corresponding to the block 84 that is represented by Expression 2 is applied to Expression 1 to perform conversion on measurement values of brightness and chromaticity taken by the front sensor 210.

Figure 10:
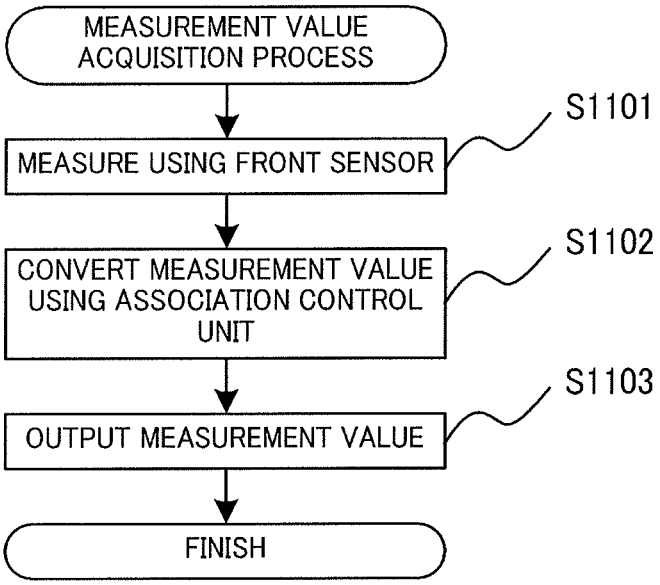
FIG. 10 is a flow chart of a measurement value acquisition process of a front sensor.

FIG. 10 is a flow chart of a measurement value acquisition process of the front sensor 210 by the PC communication unit 410. Upon receiving a control signal for front sensor measurement value acquisition from the PC 101, the PC communication unit 410 issues a measurement value acquisition request to the front sensor control unit 409 and measures brightness or chromaticity using the front sensor 210 (S1101). Next, the PC communication unit 410 delivers the brightness or chromaticity measured in S1101 to the association control unit 403 and acquires a measurement value converted into brightness or chromaticity in the vicinity of the associated center coordinate F605 from the association control unit 403 (S1102). Finally, the PC communication unit 410 outputs the acquired brightness or chromaticity in the vicinity of the associated center coordinate F605 to the PC 101 (S1103).

As described above, by converting a measurement value taken by the front sensor using association data corresponding to a region of a display mode that is a calibration target (for example, association data corresponding to a block including a center coordinate of the region), brightness or chromaticity in a diagnostic region can be obtained. In addition, since calibration is performed based on the brightness or chromaticity in a diagnostic region, calibration is possible which is based on display characteristics at a display position of the diagnostic region. Therefore, display accuracy in a diagnostic region can be enhanced by calibration regardless of where the diagnostic region is located in the screen.

Moreover, the conversion formula used in the association process shown in the present embodiment is simply an example and other conversion formulas may be used instead. In addition, the present embodiment exemplifies a configuration in which association data of each of the blocks that divide a screen in a grid pattern is obtained during manufacture and recorded on an internal storage apparatus. However, the configuration is not restrictive and a configuration may be alternatively adopted which enables a user to measure brightness or chromaticity of each block after shipment and to correct association data. Furthermore, a communication unit other than an image cable such as a universal serial bus (USB) cable may be used to transmit and receive control signals between the liquid crystal display apparatus 100 and the PC 101. In addition, while a configuration in which an association process is executed by a liquid crystal display apparatus is exemplified in the present embodiment, a configuration may be alternatively adopted in which an association process is executed by a PC connected to the liquid crystal display apparatus.

Second Embodiment

In the present embodiment, an example in which a diagnostic region is actually measured before performing an association process will be described. Moreover, descriptions of portions that overlap with the first embodiment will be omitted.

Figure 11:
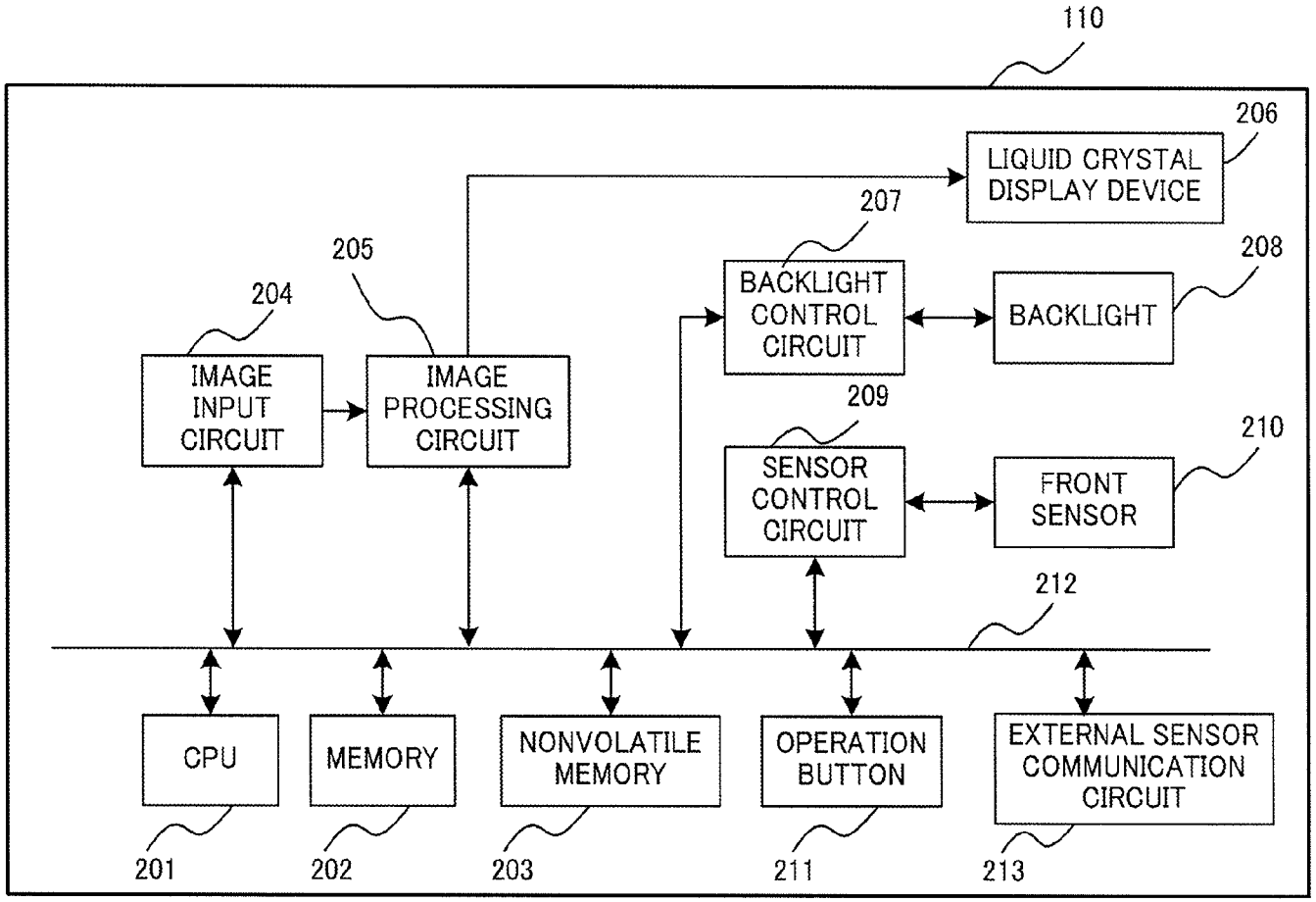
FIG. 11 is a hardware block diagram of a liquid crystal display apparatus.

FIG. 11 is a block diagram showing a hardware configuration of a liquid crystal display apparatus 110 to which a second embodiment of the present invention is applied.

An external sensor communication circuit 213 outputs control information for controlling an external sensor 103 to the external sensor 103 in response to a request from a CPU 201 and returns brightness or chromaticity as measured by the external sensor 103 to the CPU 201.

Figure 12:
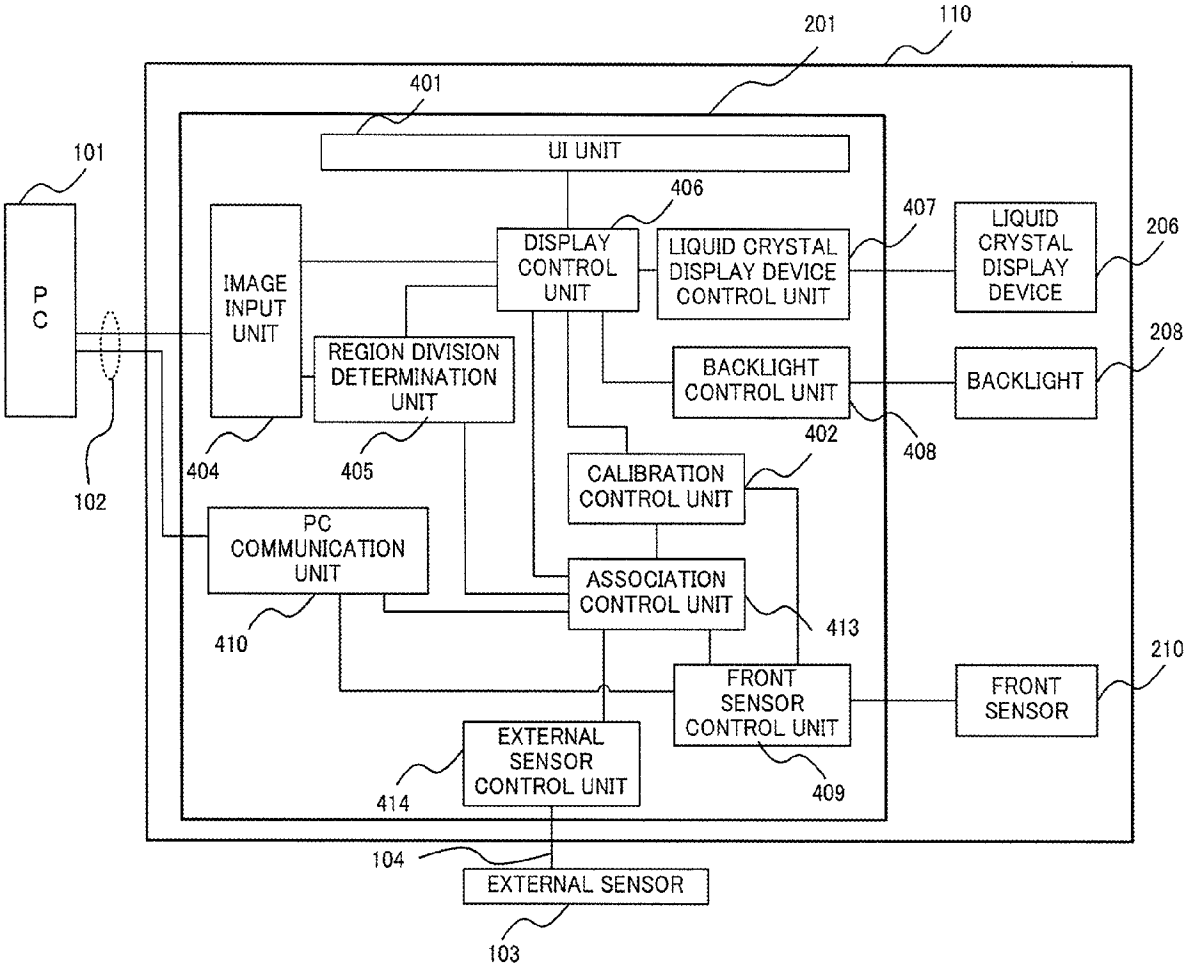
FIG. 12 is a functional block diagram of a liquid crystal display apparatus.

FIG. 12 is a diagram showing a connection mode of the liquid crystal display apparatus, an image output apparatus, and the external sensor to which the second embodiment of the present invention is applied and functional blocks of the liquid crystal display apparatus 110. Compared to the liquid crystal display apparatus 100 according to the first embodiment, the external sensor 103 is further connected by a USB cable 104 to the liquid crystal display apparatus 110. The external sensor 103 measures brightness or chromaticity of the liquid crystal display apparatus 110 based on a control signal from the liquid crystal display apparatus 110 and outputs the brightness or chromaticity to the liquid crystal display apparatus 110. Processes of the respective units shown in FIG. 12 are executed by the CPU 201.

An association control unit 413 calculates brightness or chromaticity of a specified location of the liquid crystal display apparatus 110 based on a measurement value taken by the external sensor 103 among measurement values of brightness or chromaticity acquired from the front sensor control unit 409. Details of the association process according to the present embodiment will be given later. In addition, the association control unit 403 converts brightness or chromaticity measured by a front sensor 210 based on a request from a calibration control unit 402 or a PC communication unit 410.

An external sensor control unit 414 controls the external sensor 103 in response to a measurement request received from the association control unit 413 to measure brightness or chromaticity.

Figure 13:
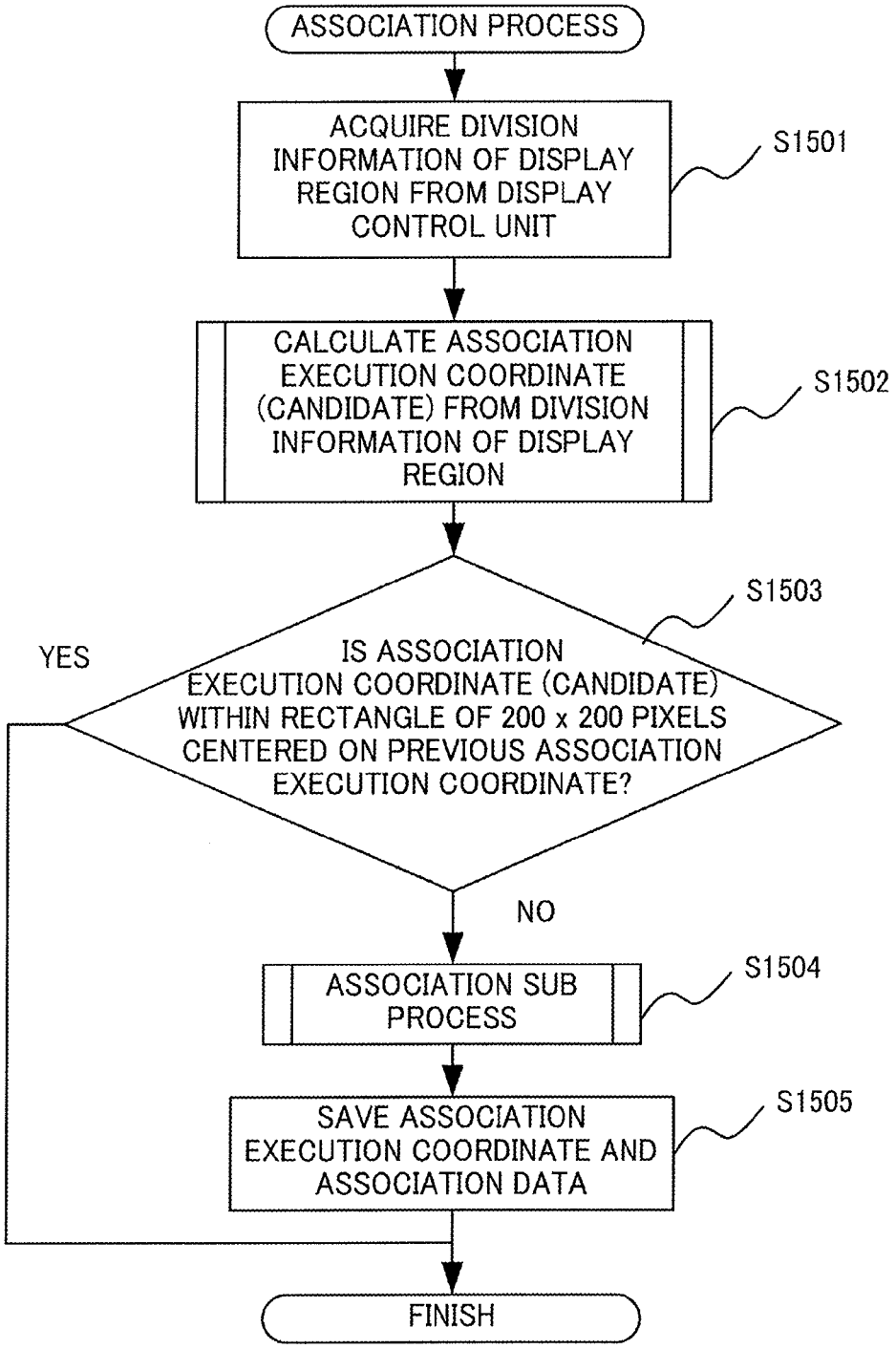
FIG. 13 is a flow chart of an association process.

FIG. 13 is a flow chart of the association process performed by the association control unit 413. Upon receiving the association execution request from the calibration control unit 402, the association control unit 413 acquires display region information which represents how the image display region is to be divided into regions and which display mode is applied to each region from the display control unit 406 (S1501). Next, the association control unit 413 calculates a candidate of an association execution coordinate from the display region information (S1502). In the case of the display state shown in FIG. 5, the association control unit 413 calculates a center coordinate F605 of the region of a display mode "DIAG_DCM" as a candidate of an association execution coordinate. Moreover, a method of calculation is similar to that shown in FIG. 9 described in the first embodiment. Subsequently, the association control unit 413 checks whether the candidate of an association execution coordinate is within a range of 200 pixels×200 pixels centered on a previous association execution coordinate (S1503). Moreover, the size of 200 pixels×200 pixels of a rectangle that is used for the determination is simply an example and is not restrictive. When the candidate of an association execution coordinate is not within this rectangle (NO in S1503), the association control unit 413 performs an association sub process (S1504). Details of the association sub process will be given later. The association control unit 413 saves association data corresponding to the association execution coordinate calculated as a result of the association sub process (S1505). Moreover, when the candidate of an association execution coordinate is within the 200 pixels× 200 pixels rectangle centered on the previous association execution coordinate (YES in S1503), since an association process need not be performed again, the association control unit 413 finishes the process.

For example, in the case of the display state shown in FIG. 5, when the previous association execution coordinate is within a rectangular region ranging from (1150, 980) to (1349, 1179), a determination of association not required (Yes) is made in S1503.

Otherwise, a determination of association required (No) is made.

Figure 14:
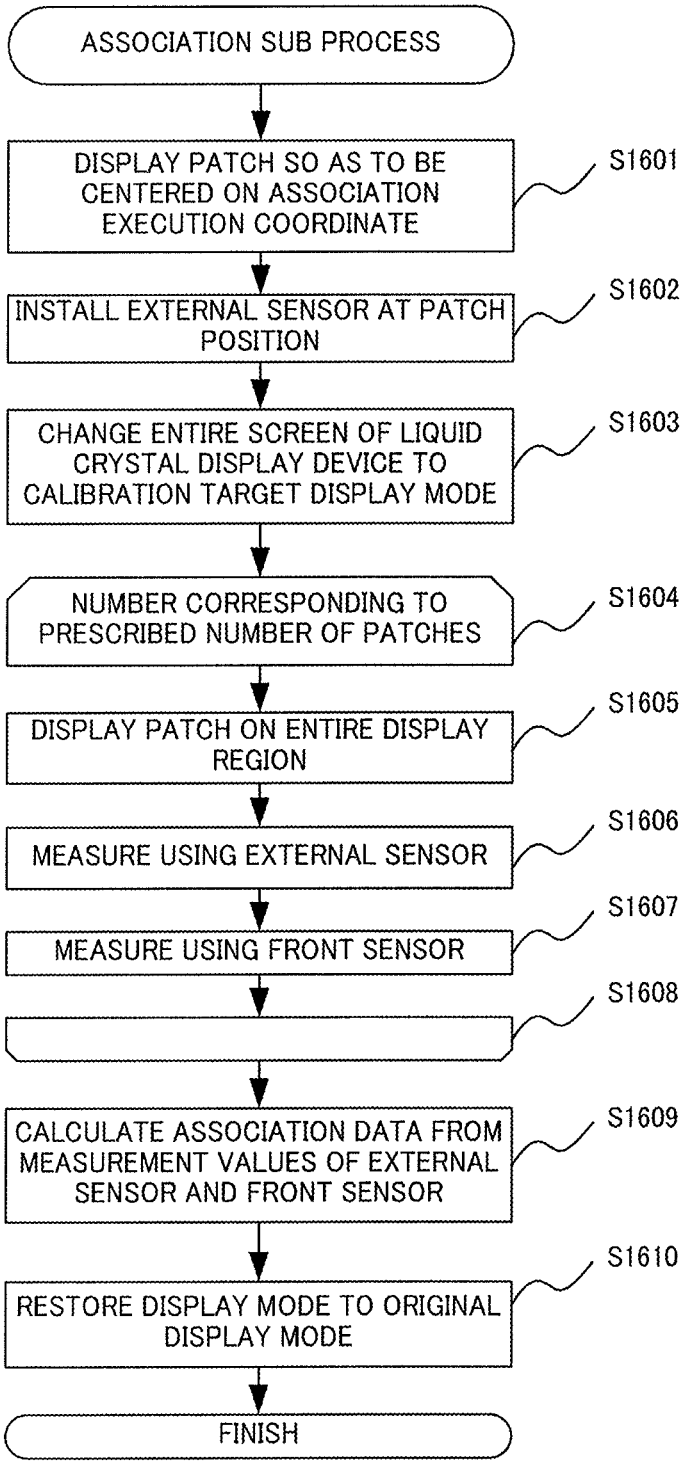
FIG. 14 is a flow chart of an association sub process.

FIG. 14 is a flow chart of the association sub process that is executed in S1504 among the processes shown in FIG. 13.

In the association sub process, first, the association control unit 413 displays a patch centered on the association execution coordinate and presents an installation position of the external sensor 103 to the user (S1601). Next, once the user installs the external sensor 103 at the position of the patch (S1602), the association control unit 413 changes a display mode of an entire image display region of the liquid crystal display apparatus 110 to a display mode that is a calibration target (S1603). In the case of the display state shown in FIG. 5, the association control unit 413 sets the display mode of the entire image display region to "DIAD_DCM". Subsequently, the association control unit 413 repeats the processes of S1605 to S1608 for a number of times corresponding to the number of patches necessary for the association process (S1604). First, the association control unit 413 displays a patch on the entire image display region (S1605). Next, the association control unit 413 acquires a measurement value of brightness or chromaticity of the patch from the external sensor 103 (S1606) and further acquires brightness or chromaticity of the patch from the front sensor 210 (S1607). Subsequently, the association control unit 413 returns to S1604 to repeat the processes described above (S1608). After measurements taken by the external sensor 103 and the front sensor 210 are finished, the association control unit 413 calculates association data from the measured brightness or chromaticity (S1609) and restores the display mode of the liquid crystal display apparatus 110 to the original display mode (S1610).

FIG. 15 is a diagram showing RGB values of a patch used for measurement in the flow chart shown in FIG. 14. The RGB values are respectively expressed by 8 bit values ranging from 0 to 255. As shown in FIG. 15, in S1604 to S1608 shown in FIG. 14, patches of five colors including black (T1701), white (T1702), red (T1703), green (T1704), and blue (T1705) are displayed.

As described above, by measuring a center of a calibration target region using an external sensor and creating (updating) association data for an association process based on the measurement, a measurement value taken by the front sensor can be more accurately associated with a center of a diagnostic region.

Moreover, in the present embodiment, a signal cable other than a USB cable may be used for the connection between the liquid crystal display apparatus 110 and the external sensor 103. In addition, while a patch is displayed on a full screen when performing an association process, a patch may be displayed only in measurement regions of the external sensor and the front sensor. Furthermore, the colors and the number of colors of patches used in the measurements are simply examples and measurements may be performed using a patch of a color other than those described in the present embodiment. In addition, while an example has been shown in which the processes described in the present embodiment are executed during the calibration process according to the first embodiment, a configuration may be adopted in which only an association process can be executed according to an instruction from the user. In addition, while a configuration in which an association process is executed by a liquid crystal display apparatus is adopted in the present embodiment, a configuration may be alternatively adopted in which an association process is executed by a PC connected to the liquid crystal display apparatus.

Third Embodiment

In the present embodiment, an example will be described in which, with respect to a liquid crystal display apparatus, a brightness distribution of the liquid crystal display apparatus is taken into consideration when determining an association execution coordinate. Moreover, descriptions of portions that overlap with the first and second embodiments will be omitted.

Figure 16:
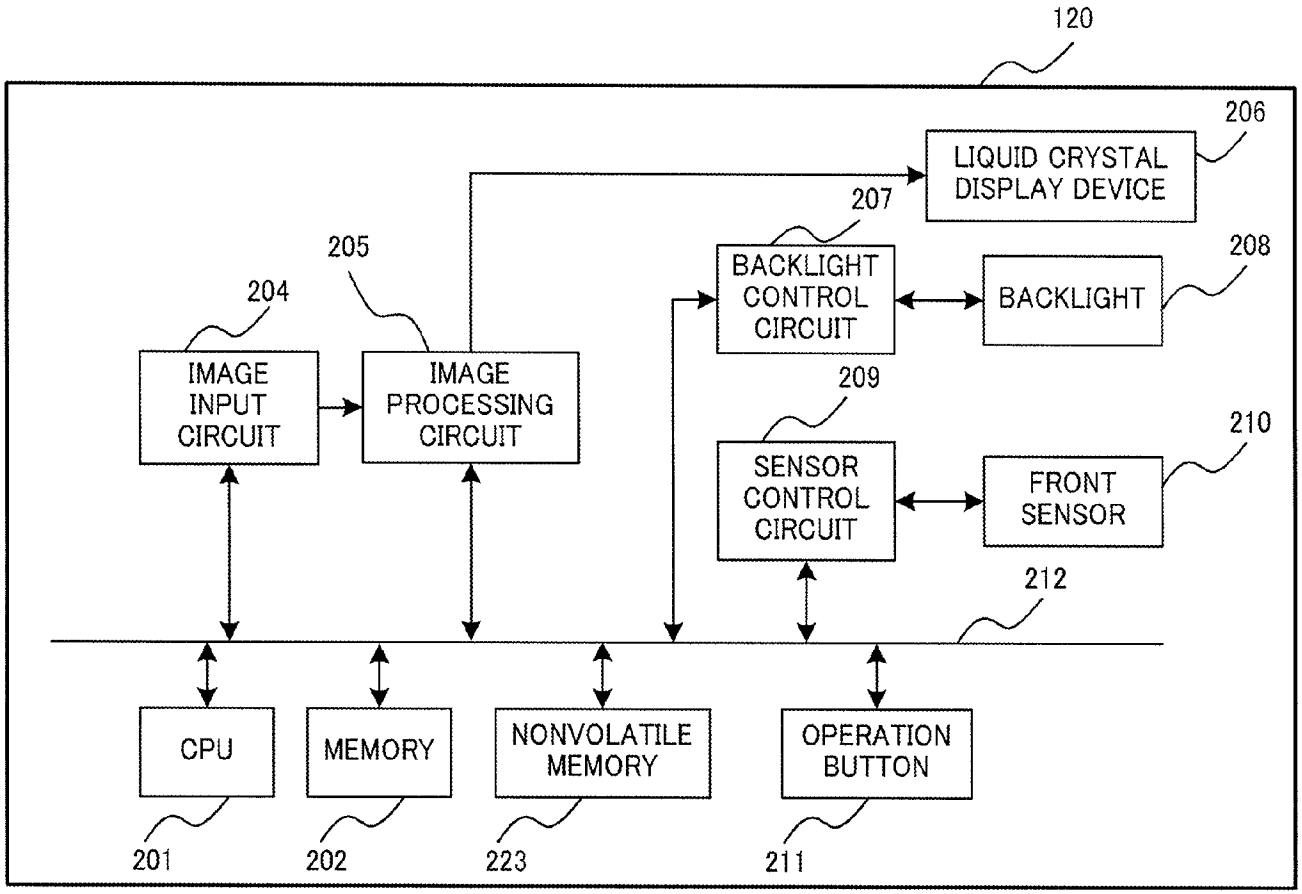
FIG. 16 is a hardware block diagram of a liquid crystal display apparatus.

FIG. 16 is a block diagram showing a hardware configuration of a liquid crystal display apparatus 120 to which a third embodiment of the present invention is applied.

A nonvolatile memory 223 stores associable region information based on a brightness distribution of the liquid crystal display apparatus 120 in addition to the information stored by the nonvolatile memory 203 shown in FIG. 1. Moreover, associable region information is measured in advance when the liquid crystal display apparatus 120 is being manufactured and stored in the nonvolatile memory 223.

Figure 17:
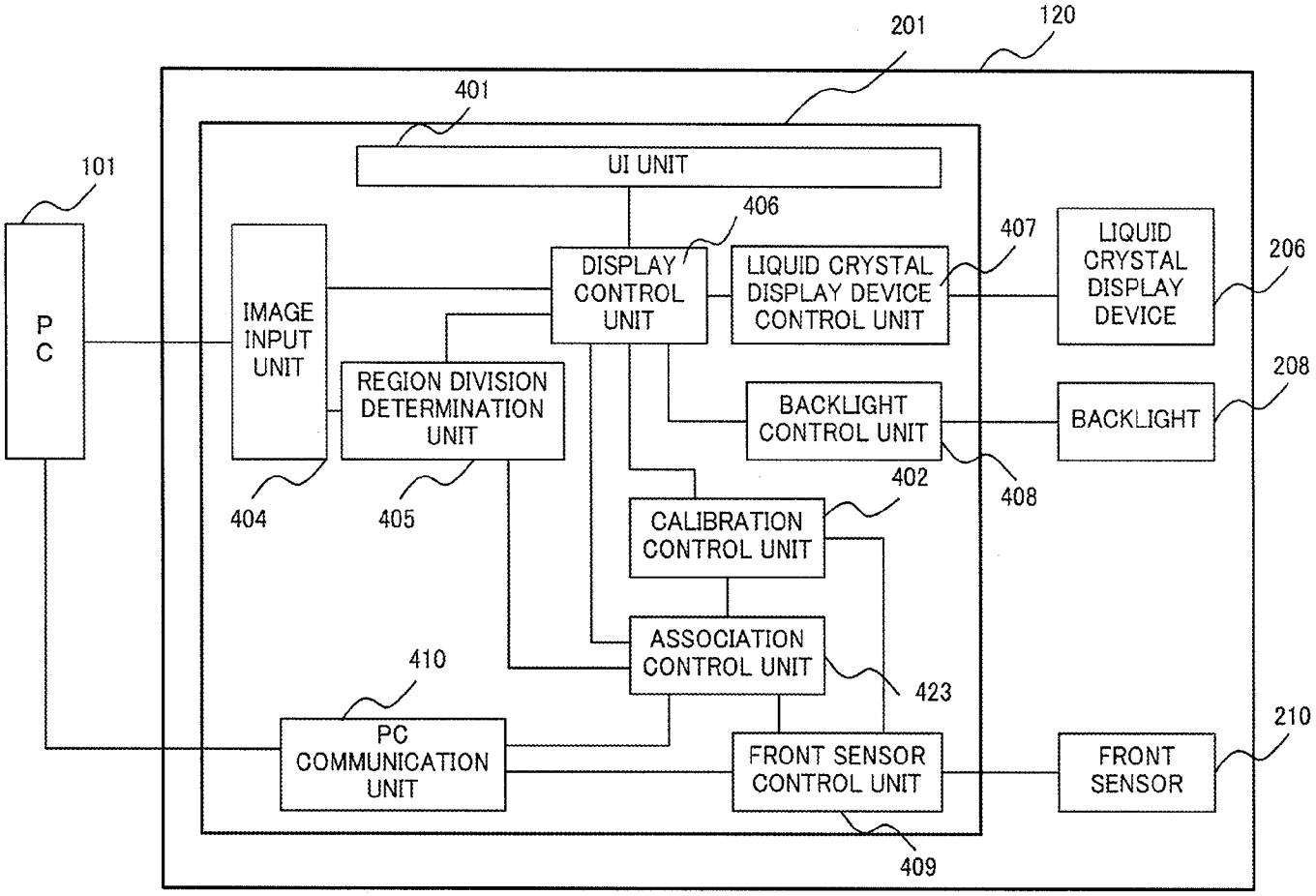
FIG. 17 is a functional block diagram of a liquid crystal display apparatus.

FIG. 17 is a functional block diagram of the liquid crystal display apparatus 120. An association control unit 423 further performs a process based on the associable region information in the association process performed by the association control unit 403 shown in FIG. 3. Details of the association process will be given later.

Figure 18:
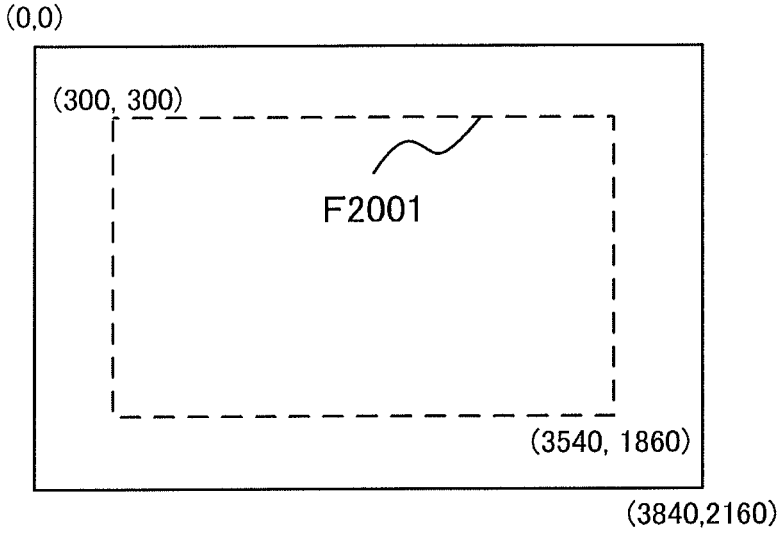
FIG. 18 is a schematic diagram of associable region information.

FIG. 18 is a schematic diagram of an associable region. A brightness distribution is measured when manufacturing the liquid crystal display apparatus 120 and a region having brightness whose separation from brightness as measured at a center of the liquid crystal display apparatus 120 is equal to or less than a threshold is assumed to be an associable region. In FIG. 18, a rectangular region F2001 depicted by a dashed line from coordinate (300, 300) to coordinate (3540, 1860) is an associable region. As shown in FIG. 18, in the present embodiment, regions in a vicinity of an edge part of the screen are regions where a separation of brightness from a center part of the screen is greater than a threshold.

Figure 19:
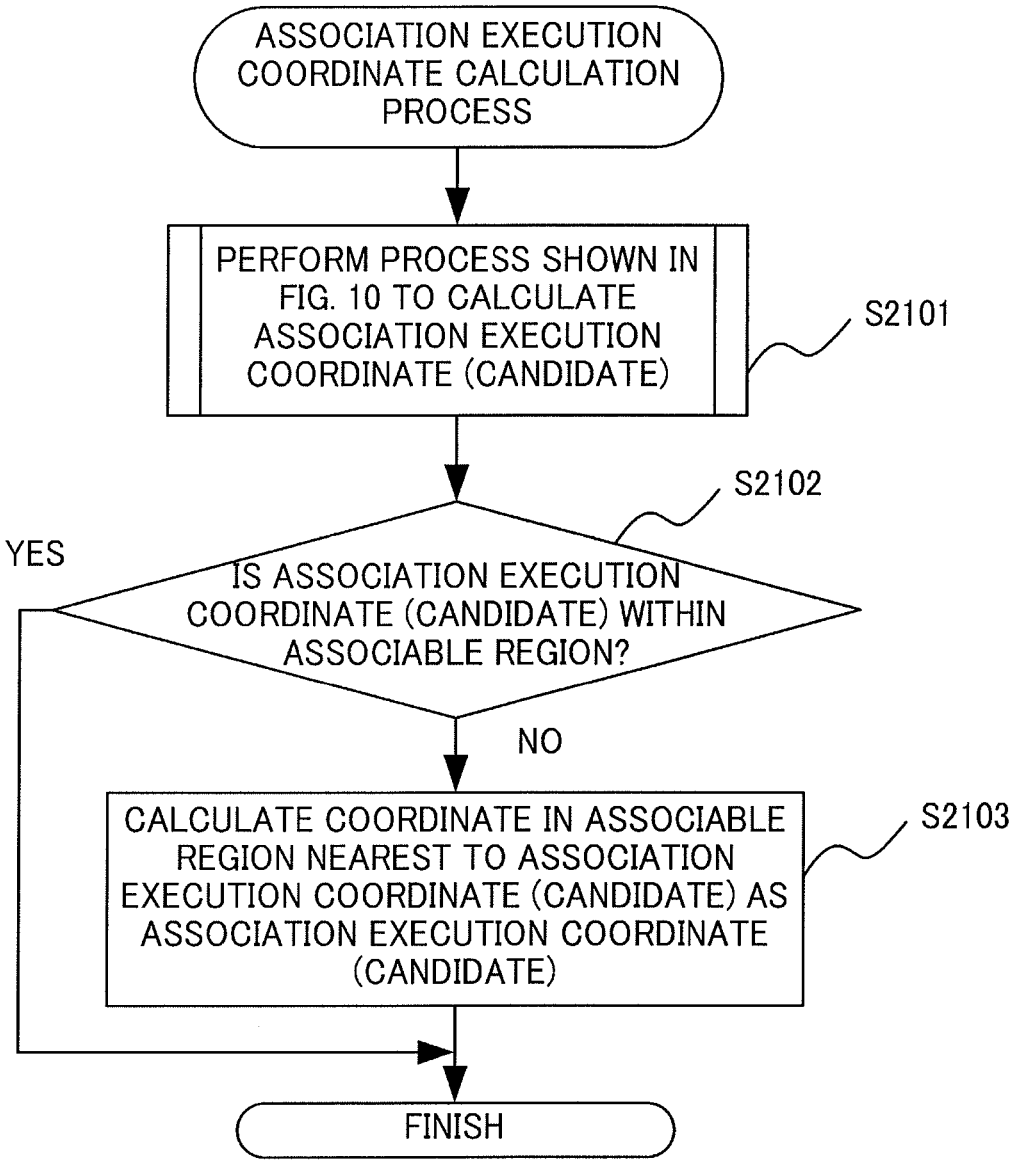
FIG. 19 is a flow chart of a process for calculating a candidate of an association execution coordinate.

FIG. 19 is a flow chart of a process of calculating a candidate of an association execution coordinate which is performed by the liquid crystal display apparatus 120 in place of the processes shown in FIG. 9. The association control unit 423 first performs the processes shown in FIG. 9 to calculate a candidate of an association execution coordinate (S2101). Next, the association control unit 423 determines whether the candidate of an association execution coordinate is included in the associable region (S2102). When the candidate of an association execution coordinate is included in the associable region (YES in S2102), the association control unit 423 finishes the process as is. When the candidate of an association execution coordinate is not included in the associable region (NO in S2102), the association control unit 423 calculates a coordinate in the associable region which is nearest to the candidate of an association execution coordinate as the candidate of an association execution coordinate (S2103).

As described above, by considering a brightness distribution of the liquid crystal display apparatus when calculating a candidate of an association execution coordinate, conversion of brightness or chromaticity of a region in a peripheral part whose brightness is more likely to decline as compared to a central part is not performed when converting brightness or chromaticity as measured by the front sensor. As a result, calibration can be performed accurately.

Moreover, while the present embodiment has been described as though applied to contents described in the first embodiment, the present embodiment can also be applied to contents described in the second embodiment.

Fourth Embodiment

In the present embodiment, information regarding division of a screen according to display modes and setting a display mode for each divided region is acquired from a PC that is an external apparatus. Moreover, descriptions of portions that overlap with the first to third embodiments will be omitted.

Figure 20:
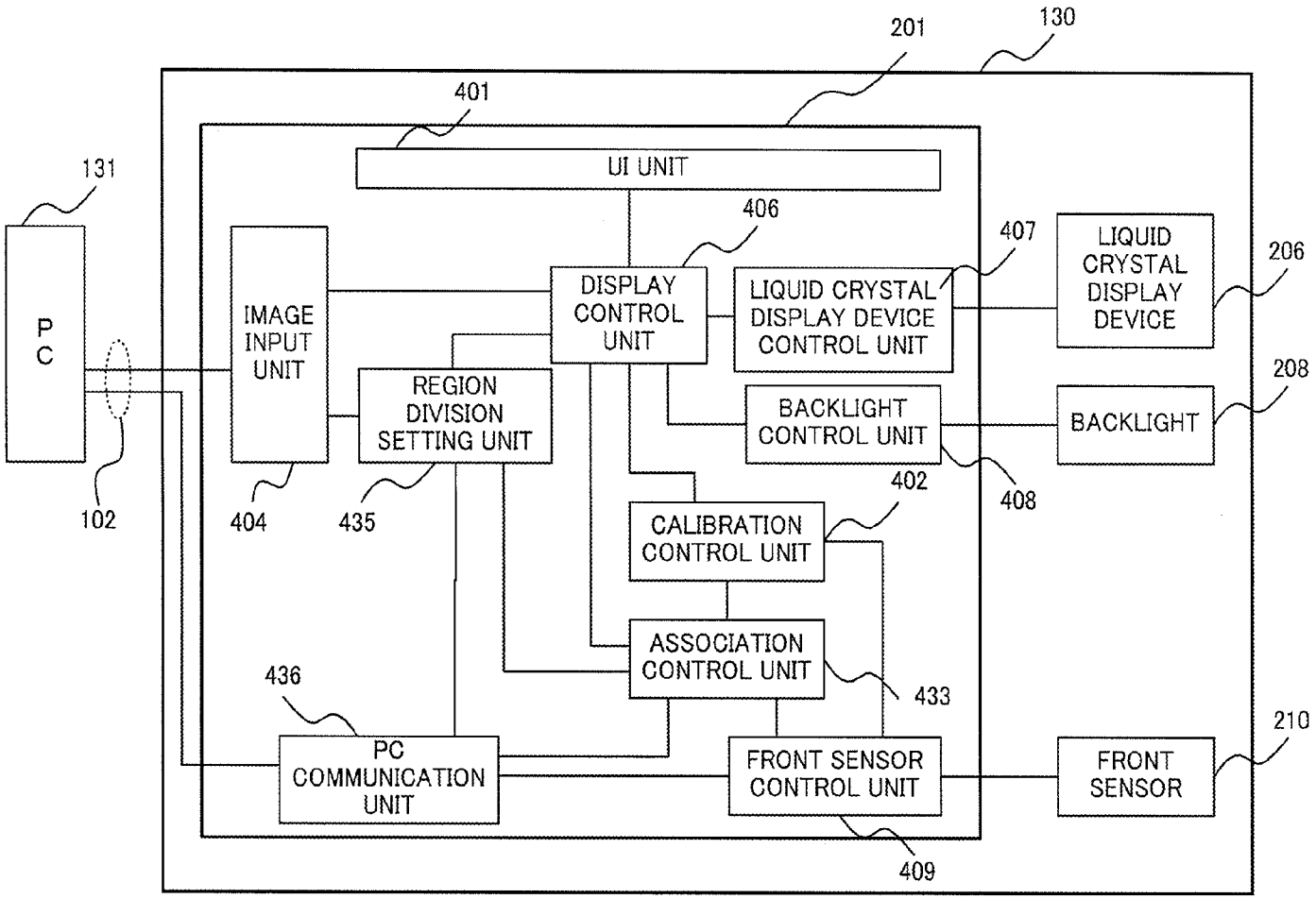
FIG. 20 is a functional block diagram of a liquid crystal display apparatus.

FIG. 20 is a diagram showing a connection between a liquid crystal display apparatus and a PC that is an image output apparatus to which the fourth embodiment of the present invention is applied and functional blocks of a liquid crystal display apparatus 130.

A PC 131 is connected using an image cable 102 to the liquid crystal display apparatus 130. The liquid crystal display apparatus 130 receives display region information of display modes in addition to image signals and control signals from the PC 131 via the image cable 102.

In the association process performed by the association control unit 403 shown in FIG. 3 according to the first embodiment, the association control unit 433 performs the process by acquiring display region information from an region division setting unit 435. Details of the association process will be given later.

The region division setting unit 435 performs region division of an image display region according to display modes based on the display region information received from a PC communication unit 436 and outputs display region information representing a display mode to be applied to each region to a display control unit 406 and the association control unit 433.

The PC communication unit 436 performs a process for outputting the display region information acquired from the PC 131 to the region division setting unit 435 in addition to the process performed by the PC communication unit 410 shown in FIG. 3 according to the first embodiment.

Figure 21:
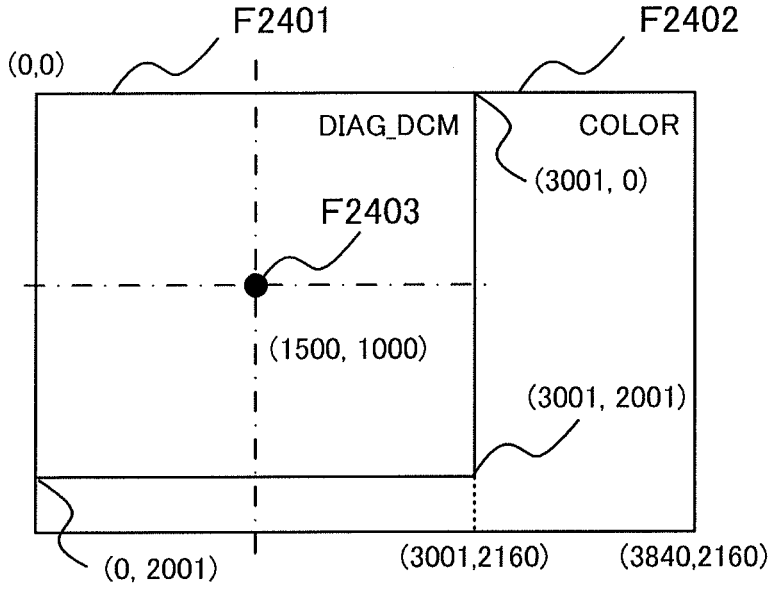
FIG. 21 shows an example of region division according to display modes of an image display region of a liquid crystal display apparatus.

FIG. 21 is a diagram showing an example of region division according to display modes of an image display region of the liquid crystal display apparatus 130 which is received from the PC 131. Among the image display region of the liquid crystal display apparatus 130, a display mode of a rectangular region F2401 from coordinate (0, 0) to coordinate (3000, 2000) is "DIAG_DCM". A display mode of a region F2402 that combines a rectangular region from coordinate (3001, 0) to coordinate (3840, 2160) with a rectangular region from coordinate (0, 2001) to coordinate (3001, 2160) is "COLOR". Moreover, in this case, a center coordinate F2403 when performing an association process (to be described later) is (1500, 1000). When performing the processes shown in FIGS. 8 and 9 in this state, a block including the coordinate F2403 is selected as an association execution block.

While configurations in which a liquid crystal display apparatus determines display modes based on an image signal have been exemplified in the first to third embodiments, the present invention can also be applied to a configuration in which information regarding region division of an image display region according to display modes is acquired from a PC as is the case of the present embodiment. Even with such a configuration, by determining a diagnostic region in which image display is being performed in a display mode that is a calibration target and performing calibration by calculating brightness or chromaticity in a vicinity of a center of the diagnostic region from a measurement value taken by a front sensor, calibration can be performed accurately.

Moreover, even in the present embodiment, communication means other than an image cable such as a USB cable may be used to transmit and receive control signals between the liquid crystal display apparatus 130 and the PC 131 in a similar manner to the first embodiment. In addition, a signal cable other than a USB cable may be used for the connection between the liquid crystal display apparatus 130 and the external sensor 103. Furthermore, while the present embodiment has been described as though applied to contents described in the first embodiment, the present embodiment can also be applied to contents described in the second and third embodiments.

While examples in which information of region division according to display modes is determined from an input image signal or acquired from a PC have been shown in the respective embodiments described above, a configuration may be alternatively adopted in which information of region division according to display modes can be manually inputted (specified) by a user.

Since the respective embodiments described above represent examples in which the present invention is applied to an image display apparatus that displays a medical image, display regions of the display modes DIAG_DCM and DIAG_CLR are attention regions that are brought into attention by a user. However, applications of the present invention are not limited to image display apparatuses that display a medical image. For example, when displaying a moving image in a window, the window displaying the moving image is an attention region and a GUI or a background other than the window is a non-attention region. In addition, even with such an image display apparatus, by applying the present invention, the operational advantage of the present invention in that calibration of an attention region can be accurately performed is obtained even if the attention region is not at a center of a screen.

While the respective embodiments described above represent examples in which the present invention is applied to a liquid crystal display apparatus, the present invention can be applied to image display apparatuses in general which are capable of performing calibration in accordance with a measurement result of brightness or chromaticity as taken by a sensor. In addition, while the respective embodiments described above represent examples in which calibration is performed by a liquid crystal display apparatus, a configuration may be alternatively adopted in which calibration is performed by a PC. In this case, the PC is a calibration apparatus that performs calibration of an image display apparatus and stores association data necessary for an association process in a storage apparatus such as a hard disk drive or a nonvolatile memory. Furthermore, the PC acquires a measurement value from a front sensor provided in the image display apparatus via an image cable, a USB cable, or the like, estimates a measurement value at a representative position of an attention region, and performs calibration so as to enhance display accuracy at the attention region based on the estimated measurement value. These processes are performed when a computer such as a CPU built into the PC executes a program installed on a hard disk or the like.

A recording medium on which a program that causes a computer to execute the association process and the calibration process based on the association process which have been described in the respective embodiments above is included in the present invention. In addition, hardware such as a function extension board that retrofits a computer such as a PC or an image display apparatus with a function for executing the association process and the calibration process based on the association process which has been described in the respective embodiments above is also included in the present invention.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-102317, filed on May 14, 2013, which is hereby incorporated by reference herein in its entirety.

What is claimed is:

1. A calibration apparatus comprising:

a sensor which measures optical characteristics at a measurement position on a screen;

a storage which stores information on correspondence determined in advance among the optical characteristics at the measurement position and optical characteristics at a plurality of prescribed positions on the screen; and a processor which performs:

acquiring a representative position of an image displayed on the screen; and calibrating based on a measurement value measured by the sensor, information on the correspondence, and a positional relationship among the plurality of prescribed positions and the representative position.

2. The calibration apparatus according to claim 1, wherein the processor further performs:

estimating, based on a measurement value measured by the sensor, information on the correspondence, and a positional relationship among the plurality of prescribed positions and the representative position, optical characteristics at the representative position; and calibrating based on the estimated optical characteristics at the representative position.

3. The calibration apparatus according to claim 2, wherein the correspondence stored in the storage is a correspondence obtained in advance between optical characteristics at the measurement position and optical characteristics at each of a plurality of blocks that divide the screen, and the processor performs estimating optical characteristics at the representative position based on a measurement value measured by the sensor and information on correspondence between optical characteristics at the measurement position and optical characteristics at a block to which the representative position belongs.

4. The calibration apparatus according to claim 2, wherein an image display apparatus having the screen is capable of displaying an image in a plurality of display modes with different parameters of image processing that is applied to an inputted image, and whether or not a display mode is a calibration target is determined for each display mode, and the processor further performs:

individually controlling a display mode for each of a plurality of divided regions that constitute the screen;

acquiring a representative position of a divided region that is displayed in a display mode that is a calibration target among the divided regions; and calibrating on the divided region from which the representative position is acquired.

5. The calibration apparatus according to claim 4, wherein the processor performs calibrating by correcting a parameter of image processing which corresponds to a display mode of a divided region on which the calibration is to be performed.

6. The calibration apparatus according to claim 4, wherein the processor performs controlling screen division and display modes according to contents of an inputted image.

7. The calibration apparatus according to claim 6, wherein the processor further performs:

dividing a screen into a region for displaying a predetermined image and a region for displaying an image other than the predetermined image among inputted images;

displaying the region of the predetermined image in a display mode suitable for the predetermined image; and displaying the region of the image other than the predetermined image in a display mode that differs from the display mode suitable for the predetermined image.

8. The calibration apparatus according to claim 4, wherein the processor further performs:

acquiring information on screen division and a display mode of each divided region from an external apparatus; and controlling screen division and display modes according to the acquired information.

9. The calibration apparatus according to claim 4, wherein the processor further performs:

accepting input of information on screen division and a display mode of each divided region from a user; and controlling screen division and the display modes according to the inputted information.

10. The calibration apparatus according to claim 4, wherein the processor performs calibrating based on optical characteristics at the representative position estimated based on a measurement value as measured by the sensor when a patch image for calibration is displayed at the measurement position in a display mode of a divided region on which the calibration is to be performed.

11. The calibration apparatus according to claim 4, wherein in a case where the division of a screen into divided regions is up-down division or left-right division, the processor performs acquiring a position of a center of a divided region that is displayed in a display mode that is a calibration target as the representative position.

12. The calibration apparatus according to claim 2, wherein the processor further performs:

acquiring a measurement value of optical characteristics at the representative position; and updating information on the correspondence based on the acquired measurement value at the representative position and a measurement value of optical characteristics at the measurement position measured by the sensor.

13. The calibration apparatus according to claim 12, wherein the processor performs acquiring a measurement value of optical characteristics at the measurement position and a measurement value of optical characteristics at the representative position in a state where a same patch is displayed at the representative position and the measurement position.

14. The calibration apparatus according to claim 12, wherein the processor does not perform updating in a case where a representative position at which optical characteristics were previously estimated and a representative position at which optical characteristics are to be currently estimated are within a prescribed range.

15. The calibration apparatus according to claim 1, wherein in a case where the acquired representative position is a position in a region in a vicinity of an edge part whose separation from brightness at a central part in a brightness distribution of the screen is equal to greater than a threshold, the processor further performs defining a position which is not in the region in the vicinity of the edge part and which is nearest to the acquired representative position as the representative position.

16. An image display apparatus comprising the calibration apparatus according to claim 1.

17. A control method of a calibration apparatus, the method comprising:

acquiring optical characteristics measured by a sensor at a measurement position on a screen;

acquiring information on correspondence determined in advance among the optical characteristics at the measurement position and optical characteristics at a plurality of prescribed positions on the screen;

acquiring a representative position of an image displayed on the screen; and performing calibration based on the measurement value measured by the sensor, information on the correspondence, and a positional relationship among the plurality of prescribed positions and the representative position.

18. A non-transitory computer readable storage medium storing a program that causes a computer to execute the control method of a calibration apparatus according to claim 17.

19. The control method according to claim 17, further comprising:

estimating, based on a measurement value measured by the sensor, information on the correspondence, and a positional relationship among the plurality of prescribed positions and the representative position, optical characteristics at the representative position, and performing calibration based on the estimated optical characteristics at the representative position.

20. The control method according to claim 19, wherein the correspondence is a correspondence obtained in advance between optical characteristics at the measurement position and optical characteristics at each of a plurality of blocks that divide the screen, and the optical characteristics at the representative position is estimated based on a measurement value measured by the sensor and information on correspondence between optical characteristics at the measurement position and optical characteristics at a block to which the representative position belongs.

* * * * *